US005456803A

United States Patent [19]

Tokuno

[11] Patent Number: 5,456,803

[45] Date of Patent: Oct. 10, 1995

[54] PAPERMAKING APPARATUS AND MULTI-LAYER PAPER FORMING APPARATUS

[75] Inventor: Masateru Tokuno, Tokyo, Japan

[73] Assignee: SK Engineering Ltd., Tokyo, Japan

[21] Appl. No.: 160,433

[22] Filed: Dec. 1, 1993

[30] Foreign Application Priority Data

Mar. 24, 1993 [JP] Japan ..... 5-064435

[51] Int. Cl.[6] ..... D21F 1/36; D21F 11/04

[52] U.S. Cl. ..... 162/304; 162/133; 162/301

[58] Field of Search ..... 162/300, 301, 162/352, 304, 351, 133

[56] References Cited

U.S. PATENT DOCUMENTS

| | | | |
|---|---|---|---|
| 2,881,670 | 4/1959 | Thomas | 162/301 |
| 3,573,162 | 3/1971 | Brezinski | 162/303 |
| 3,746,613 | 7/1973 | Vauhkonen | 162/301 |
| 3,795,576 | 3/1974 | Watanabe | 162/304 |
| 4,004,968 | 1/1977 | Braun et al. | 162/304 |
| 4,306,934 | 12/1981 | Seppanen | 162/351 |
| 4,714,521 | 12/1987 | Fujiwara | 162/300 |
| 4,999,087 | 3/1991 | Ebihara et al. | 162/301 |
| 5,167,770 | 12/1992 | Bubik et al. | 162/352 |

FOREIGN PATENT DOCUMENTS

| | | | |
|---|---|---|---|
| 2000660 | 9/1970 | Germany . | |
| 3138133 | 3/1983 | Germany | 162/300 |
| 4031038 | 4/1992 | Germany | 162/304 |
| 55-152893 | 11/1980 | Japan . | |

*Primary Examiner*—Karen M. Hastings
*Attorney, Agent, or Firm*—Ratner & Prestia

[57] ABSTRACT

A papermaking apparatus that can form a paper web having a good fiber formation is disclosed. A plurality of vertically adjustable forming rolls are provided on the top surface of an endless felt couch between a lead-in roll and a couch roll, and stationary forming bars are provided on the bottom surface of a wire screen. The endless felt couch and the wire screen, between which paper stock is interposed, are caused to move by undulation to generate pulses, which in turn apply shear force onto the paper web to dewater the paper web while facilitating fiber dispersion on the paper web.

8 Claims, 3 Drawing Sheets

PAPERMAKING APPARATUS AND MULTI-LAYER PAPER FORMING APPARATUS

BACKGROUND OF THE INVENTION

1. Field of the Invention

This invention relates generally to a papermaking apparatus, and more particularly to a papermaking apparatus that can manufacture paper having good fiver texture. This invention also relates to a multi-layer paper forming apparatus having a plurality of such papermaking apparatuses.

2. Description of the Prior Art

A conventional type of papermaking apparatus basically comprises a flow box 32 for feeding paper stock to the wire-screen cylinder 31, a wire-screen cylinder 31 for dewatering the paper stock, and a couch roll 33 for forcing an endless felt couch 34 onto the wire-screen cylinder 31 to transfer a wet paper web to the bottom surface of the endless felt couch 34 to feed to the succeeding process, as shown in FIG. 1.

In such a conventional type of papermaking apparatus, the paper stock injected from the flow box 32 is dewatered by the wire-screen cylinder 31, and then the endless felt couch 34 is forced onto the wire-screen cylinder 31 by the couch roll 33. As pulses are generated by the pressure of the couch roll 33 exerted onto the endless felt couch 34, shear force is applied to dewater the paper stock, with the water draining inside the wire-screen cylinder 31. As a result, a wet paper web is produced and transferred to the bottom surface of the endless felt couch 34.

In the conventional type of papermaking apparatus, when paper stock is fed from the flow box 32 to the wire-screen cylinder 31, a fiber texture of paper is already formed but only to an insufficient degree. The fiber texture is therefore modified later by the shear force based on pulses caused by the pushing force of the couch roll 33.

The aforementioned conventional type of papermaking apparatus has the following problems.

(1) The number of pulses is few because pulses are generated at only one location. Consequently, the fiber texture formed by the flow box 32 is not adequately modified, and a good texture cannot be obtained.

(2) At higher speeds, the wet paper web tends to disintegrate at the contact area of the couch roll 33, making it impossible to increase the amount of deposition of the wet paper web per wire-screen cylinder, and accordingly the amount of paper stock to be fed. As a result, it is difficult to form a thick paper web.

SUMMARY OF THE INVENTION

It is an object of this invention to provide a papermaking apparatus that can form a paper web having a good fiber texture.

It is another object of this invention to provide a multi-layer paper forming apparatus that can form multi-layer paper having a good fiber texture.

The papermaking apparatus of this invention comprises a wire screen circulating over a path, including a horizontal part, between a first roll and a second roll, an endless felt couch also circulating along the top surface of the horizontal part of the wire screen at the same speed as that of the wire screen, a flow box feeding paper stock in between the horizontal part of the wire screen and the endless felt couch from the side of the first roll, a pulse inducing means provided between the first and second rolls for causing the wire screen and the endless felt couch, between which the paper stock is interposed, to travel by undulation, exerting pulses to the paper stock at a plurality of locations to facilitate fiber dispersion on the paper stock and dewater the paper stock to form a wet paper web, and a couch roll for forcing the wire screen and the endless felt couch that clear the pulse inducing means onto the second roll to transfer the wet paper web on the wire screen to the endless felt couch.

The pulse inducing means comprises a plurality of forming rolls provided at a predetermined spacing on the top surface of the endless felt couch, and a plurality of forming bars provided at a predetermined spacing on the bottom surface of the wire screen; the forming roll being disposed between each of the forming bars; and the forming rolls and bars being adjustable for their vertical relative positions in such a manner that the wire screen and the endless felt couch, between which the paper stock is interposed, can travel by undulation between the forming rolls and bars.

The multi-layer paper forming apparatus has a plurality of the papermaking apparatuses in series, and at least one unit of the papermaking apparatuses comprising the multi-layer paper forming apparatus is the papermaking apparatus of this invention.

DESCRIPTION OF THE EXEMPLARY EMBODIMENTS

Figure 2:
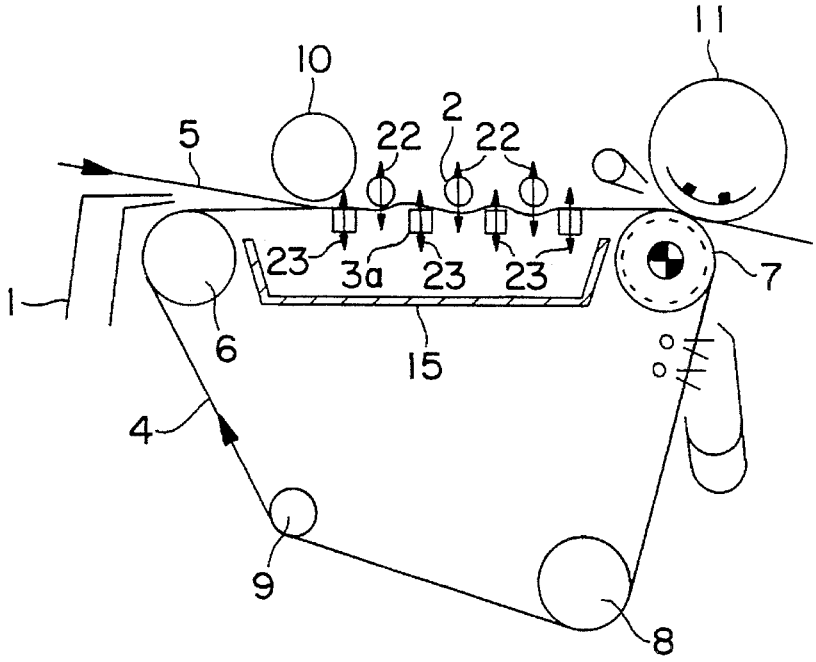
FIG. 2 is a diagram showing a papermaking apparatus embodying this invention.

FIG. 2 shows a papermaking apparatus embodying this invention. This papermaking apparatus has a circulating wire screen 4 of a relatively short length passing over a breast roll 6, a drive roll 7, a stretch roll 8 and a guide roll 9. The wire screen 4 is caused to travel in the horizontal direction between the breast roll 6 and the drive roll 7. On the side of the breast roll 6 opened is a flow box 1 along the upper horizontal part of the wire screen 4. Paper stock is fed from the flow box 1 to the wire screen 4. A lead-in roll 10 is provided facing the paper stock at a predetermined spacing toward the open end of the flow box 1. A couch roll 11 that can force the wire screen 4 and the endless felt couch 5, between which a wet paper web is interposed, onto the drive roll 7 is provided.

A plurality of forming bars 3*a* are fixedly fitted at a predetermined spacing in the horizontal direction to the bottom surface of the wire screen 4 between the lead-in roll 10 and the couch roll 11. A plurality of forming rolls 2 of a relatively small diameter are provided at a predetermined spacing in the horizontal direction on the top surface of the endless felt couch 5. The individual forming rolls 2 are disposed between each of the forming bars 3*a*. These forming rolls 2 are supported so as to be vertically movable in combination or singly as indicated by the arrows 22.

The endless felt couch 5 passes about the lead-in roll 10, the forming bars 3*a*, the forming rolls 2 and the couch roll 11. While the endless felt couch 5 and the wire screen 4 travel between the forming bars 3*a* and the forming rolls 2, both of which are disposed vertically, the endless felt couch 5 and the wire screen 4 are allowed to travel by undulation when the forming rolls 2 are moved downward and fixedly fitted to a position where the forming rolls 2 and the forming bars 3*a* overlap with each other in the direction vertical to the traveling direction.

A vacuum-type stationary dewatering apparatus 15 is provided beneath the forming bars 3*a* and between the breast roll 6 and the drive roll 7.

In the papermaking apparatus having the aforementioned construction, paper stock injected from the flow box 1 is fed in between the wire screen 4 and the endless felt couch 5, and travels toward the part where the forming rolls 2 and the forming bars 3*a* are disposed. Since the paper stock interposed between the wire screen 4 and the endless felt couch 5 travels by undulation between the forming bars 3*a* and the forming rolls 2, pulses are induced to the paper stock at a plurality of locations. By the pulse pressure of these pulses, shear force is applied to the paper web, facilitating fiber dispersion, and dewatering the paper web.

As generated at a plurality of locations, a large number of pulses are generated, thus adding adequate modification to the fiber texture formed in the flow box 1. As a result, a good fiber texture of paper can be achieved.

In this case, furthermore, excess pulse pressure can be distributed by the cushioning effect of the endless felt couch 5, preventing the paper web from disintegrating. As a result, the amount of paper stock and therefore the amount of deposition of paper stock can be increased.

Dewatering of the paper web is effected by the pulse pressure exerted to the paper web, but dewatering can be intensified by the vacuum action of the stationary dewatering apparatus 15.

The paper web formed on the wire screen 4 in the aforementioned manner is transferred to the bottom surface of the endless felt couch 5 by forcing the couch roll 11 onto the drive roll 7 and fed to the succeeding process.

In this embodiment, the pressure and number of pulses being generated can be changed freely in the following manner. That is, the pulse pressure can be increased by increasing the overlap in the vertical direction of the forming bars 3*a* and the forming rolls 2 by adjusting the vertical position of the forming bars and the forming rolls as indicated by the arrows 22. By doing this, the amplitude of the undulatory movement can be increased, and the pulse pressure can be increased. The number of pulses can be changed by changing the number of the forming rolls 2 and the forming bars 3*a*.

As described above, this invention makes it possible to generate pulses with an extremely simple mechanism and change the pressure and number of pulses freely, a good fiber texture free of web collapse can be accomplished.

Although it is assumed in the above embodiment that the forming bars 3*a* are stationary, and the forming rolls 2 are vertically movable, the forming bars 3*a* may be movable and the forming rolls 2 stationary, or both may be movable as indicated by the arrows 22 and 23.

Figure 1:
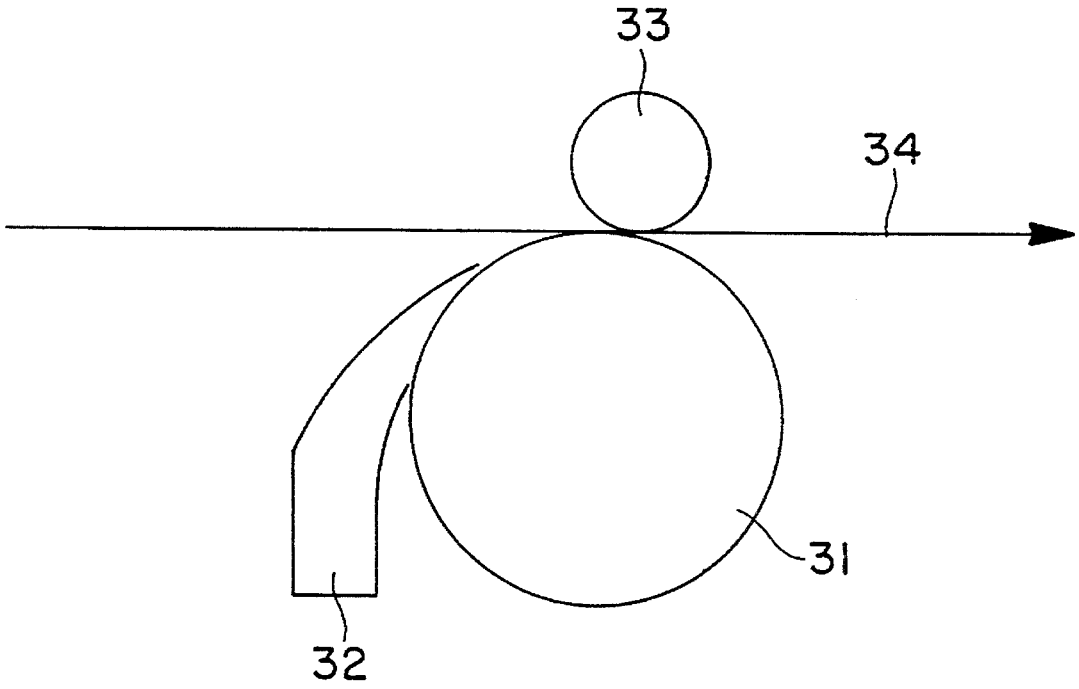
FIG. 1 PRIOR ART
FIG. 1 (prior art) is a diagram showing a conventional type of papermaking apparatus.
Figure 3:
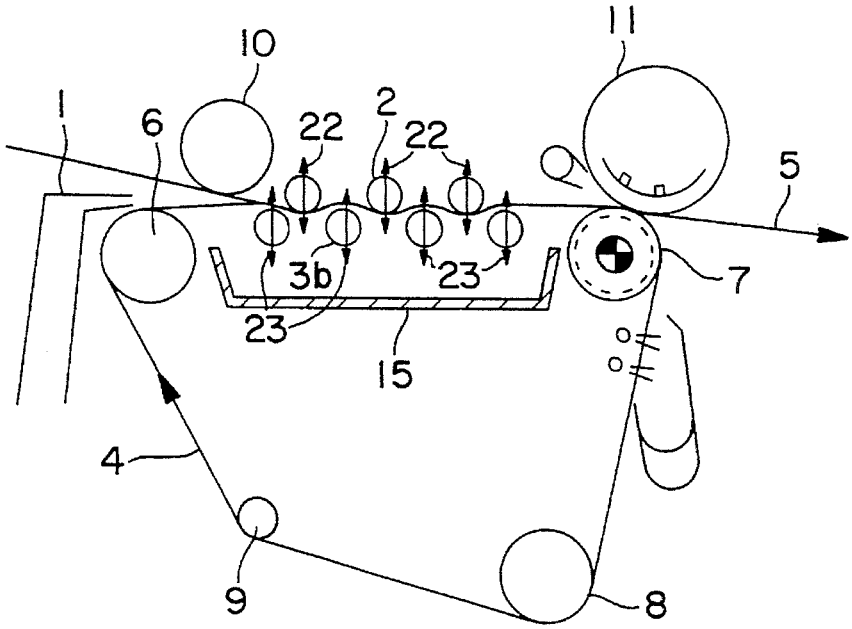
FIG. 3 is a diagram showing another papermaking apparatus embodying this invention.

FIG. 3 is a diagram illustrating another embodiment of this invention. This embodiment is different from that shown in FIG. 2 in that the forming bars 3*a* in FIG. 1 are replaced with table rolls 3*b*, and the other construction is exactly the same as that of FIG. 2. In FIG. 3, therefore, like parts are indicated by like numerals used in FIG. 2. In this embodiment, too, as the endless felt couch 5 and the wire screen 4, between which paper stock is interposed, travel by undulation between the table rolls 3*b* and the forming rolls 2, pulses are generated, exerting pulse pressure onto the paper stock. As in the case of the embodiment shown in FIG. 2, a large number of pulses are generated because they are generated at a plurality of locations. Thus, adequate modification can be made on the fiber texture formed in the flow box 1, leading to a better texture. Furthermore, since excess pulse pressure can be distributed by the cushioning effect of the endless felt couch 5, preventing the paper web from collapsing, the amount of paper stock and therefore the amount of deposition of paper stock can be increased. Either the forming rolls 2 or the table rolls 3*b* may be individually adjusted in position vertically as indicated by the arrows 22 and 23.

The aforementioned two embodiments are concerned with the papermaking apparatus for manufacturing single-layer paper, but it is obvious that a multi-layer paper forming apparatus can be accomplished by connecting in series a plurality of the papermaking apparatuses.

Figure 4:
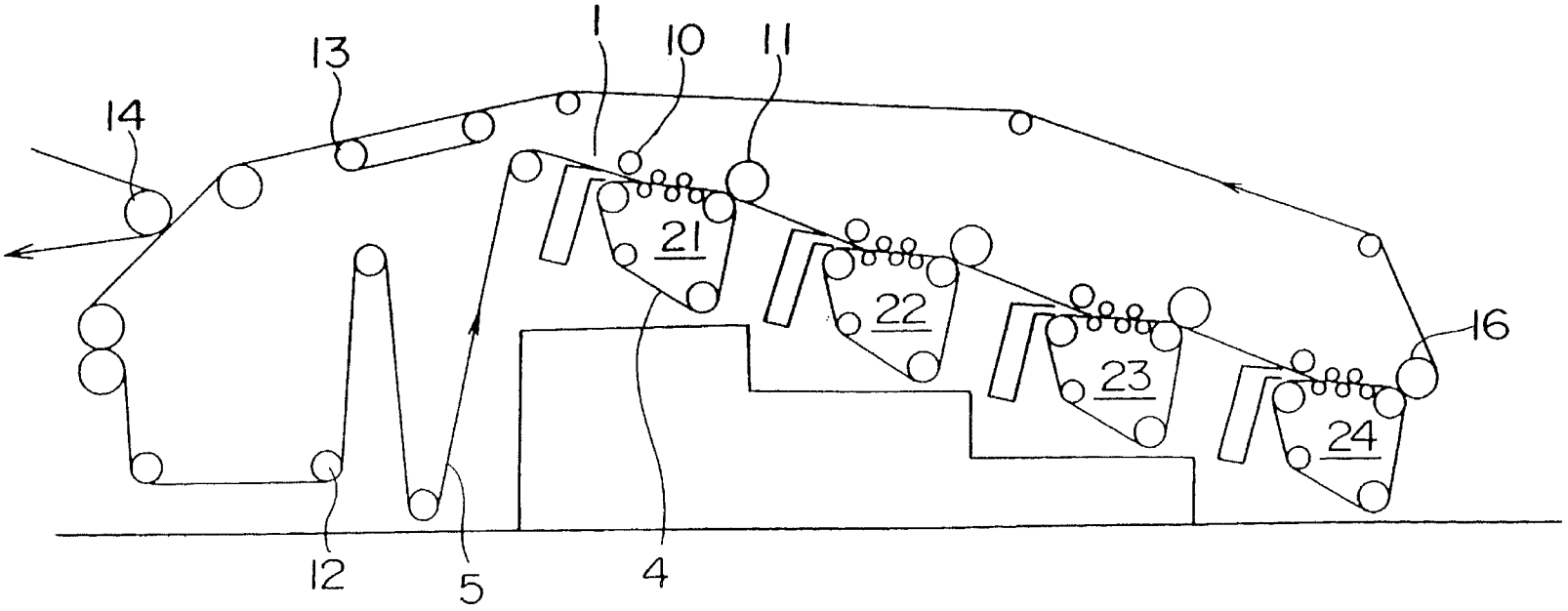
FIG. 4 is a diagram showing a multi-layer paper forming apparatus embodying this invention.

FIG. 4 is an embodiment of a multi-layer paper forming apparatus in which 4 units of the papermaking apparatuses shown in FIG. 3 are provided. In the interest of simplicity, the stationary dewatering apparatuses on the papermaking apparatuses 21, 22, 23 and 24 are omitted. The couch roll of the papermaking apparatus 24 as the final unit is composed of a suction couch roll 16. The endless felt couch 5 passes over the rolls of four units of the papermaking apparatuses 21, 22, 23 and 24 to connect them. In the figure, numeral 12 refers to a felt roll, 13 to a long suction device, and 14 to a suction pickup roll, respectively.

In a multi-layer paper forming apparatus having the aforementioned construction, a first paper layer transferred on the bottom surface of the endless felt couch 5 in the first papermaking apparatus 21 is fed to the second papermaking apparatus 22. In the second papermaking apparatus 22, a second paper layer is laminated on the first layer, and the resulting two-layer paper web is fed to the third papermaking apparatus 23. In the third papermaking apparatus 23, a third paper layer is laminated on the combined paper web consisting of the first and second paper layers and the resulting three-layer paper web is fed to the fourth papermaking apparatus 24. In the fourth papermaking apparatus 24, a fourth paper web is laminated on the paper web consisting of the first, second and third paper layers, and the resulting wet paper web consisting of four paper layers is formed. The papermaking apparatus 24 uses a suction couch roll 16 in place of the couch roll to ensure the transfer of the wet paper web to the endless felt couch 5.

The multi-layer paper web thus formed is transferred to the endless felt couch 5 by means of the suction couch roll 16 of the papermaking apparatus 24 as the final unit, and fed to the next process. The multi-layer paper web is further dewatered halfway in the long suction device 13 installed in the loop of the endless felt couch 5 to increase the paper content of the web, and picked up by the suction pickup roll 14 and fed to the next process (press part).

In the aforementioned multi-layer paper forming apparatus, the fiber formation of each layer is good because adequate modification is made on fiber formation by the pulses generated by the undulatory movement of the endless felt couch 5 and the wire screen 4.

In the multi-layer paper forming apparatus described above, the papermaking apparatuses of this invention are used for all the component units, but not all the component units must be the papermaking apparatuses of this invention. In the multi-layer paper forming apparatus in which a plurality of the conventional papermaking apparatus as described in FIG. 1 are connected in series, for example, at least one unit may be replaced with the papermaking apparatus of this invention.

As described above, the papermaking apparatus of this invention can accomplish a paper web having good fiber formation because pulses are generated at a plurality of locations by causing an endless felt couch and a wire screen, between which paper stock is interposed, to move by undulation with an extremely simple mechanism to facilitate fiber dispersion and dewatering by means of the shear force caused by these pulses.

The cushioning effect of the endless felt couch helps distribute excess pulse pressure, making it difficult for paper stock to disintegrate. Thus, the papermaking apparatus of this invention can form a thicker paper web at the same speed, compared with the conventional type of papermaking apparatus as shown in FIG. 1

Furthermore, by using the multi-layer paper forming apparatus of this invention, in which the papermaking apparatus of this invention can be used for at least one component unit, a wide variety of paper manufacturing can be accomplished, depending on the material of paper stock, the thickness of multi-layer paper.

The invention claimed is:

1. A papermaking apparatus comprising:

a wire screen circulating over a path, including a horizontal part, between a first roll and a second roll, an endless felt couch circulating along the top surface of the horizontal part of said wire screen at the same speed as the speed of said wire screen, a flow box for feeding paper stock from the side of said first roll in between said wire screen and said endless felt couch in said horizontal part, a pulse inducing means provided between said first and second rolls for applying pulses to said paper stock at a plurality of locations by causing said wire screen and said endless felt couch, between which said paper stock is interposed, to move by undulation to dewater said paper stock through said wire screen while facilitating fiber dispersion on said paper stock to form a wet paper web, wherein the endless felt couch acts to distribute any excess pressure caused by the pulse inducing means to prevent the wet paper web from disintegrating, and a couch roll for transferring a wet paper web on said wire screen to said endless felt couch by forcing said wire screen and said endless felt couch that has cleared said pulse inducing means onto said second roll.

2. A papermaking apparatus according to claim 1 in which said pulse inducing means comprises a plurality of forming rolls provided at a predetermined spacing on the top surface of said endless felt couch, and a plurality of forming bars provided at a predetermined spacing on the bottom surface of said wire screen; said forming rolls being disposed between each of said forming bars, and said forming rolls and said forming bars being adjustable for the respective vertical relative positions thereof so that said wire screen and said endless felt couch, between which paper stock is interposed, travel by undulation between said forming rolls and said forming bars.

3. A papermaking apparatus, according to claim 1, in which said pulse inducing means comprises a plurality of forming rolls provided at a predetermined spacing on the top surface of said endless felt couch, and a plurality of table rolls provided at a predetermined spacing on the bottom surface of said wire screen; said forming rolls being disposed between each of said table rolls, and said forming rolls and said table rolls being adjustable for the respective vertical relative positions thereof so that said wire screen and said endless felt couch, between which paper stock is interposed, travel by undulation between said forming rolls and said table rolls.

4. A papermaking apparatus as claimed in claim 2 wherein said forming bars are stationary, and said forming rolls are supported in such a manner that said forming rolls are vertically movable in combination or singly.

5. A papermaking apparatus as claimed in claim 3 wherein said table rolls are stationary, and said forming rolls are supported in such a manner that said forming rolls are vertically movable in combination or singly.

6. A papermaking apparatus as claimed in claim 2 wherein said forming bars and said forming rolls are supported in such a manner that said forming bars and said forming rolls are vertically movable in combination or singly.

7. A papermaking apparatus as claimed in claim 3 wherein said table rolls and said forming rolls are supported in such a manner that said table rolls and said forming rolls are vertically movable in combination or singly.

8. A multi-layer paper forming apparatus comprising a plurality of papermaking apparatuses in which at least one unit of said papermaking apparatuses is a papermaking apparatus set forth in any one of claims 1–7.

* * * * *